United States Patent [19]

Coberley

[11] 3,949,282

[45] Apr. 6, 1976

[54] REGISTER CONTROL SYSTEM AND METHOD

[75] Inventor: Daniel A. Coberley, Danville, Ill.

[73] Assignee: Hurletron Altair, Danville, Ill.

[22] Filed: May 28, 1974

[21] Appl. No.: 473,706

[52] U.S. Cl. ..... 318/85

[51] Int. Cl.[2] ..... H02P 5/00

[58] Field of Search ..... 318/85, 6, 7

[56] References Cited

UNITED STATES PATENTS

| | | | |
|---|---|---|---|
| 2,760,137 | 8/1956 | Andrews | 318/85 X |
| 3,428,877 | 2/1969 | Cambell et al. | 318/85 |
| 3,694,634 | 9/1972 | Horst et al. | 318/85 X |
| 3,828,168 | 7/1974 | O'Callaghan et al. | 318/85 X |

*Primary Examiner*—Robert K. Schaefer
*Assistant Examiner*—W. E. Duncanson, Jr.
*Attorney, Agent, or Firm*—Hill, Gross, Simpson, Van Santen, Steadman, Chiara & Simpson

[57] ABSTRACT

A register control system is disclosed for maintaining longitudinal or lateral register of a moving web wherein a comparator has a first input controlled in accordance with error count and has a second input controlled by a resistance-capacitance timing circuit with a non-linear characteristic such as to compensate for the non-linear characteristic of the digital to analog converter responsive to error count, and thus to provide a correction motor on time linearly proportional to error count. An adaptive circuit is provided responsive to web speed and providing for a correction cycle with respect to each repeat length of the web at relatively low web speeds, but providing for skipping of alternate error cycles at higher web speed.

3 Claims, 14 Drawing Figures

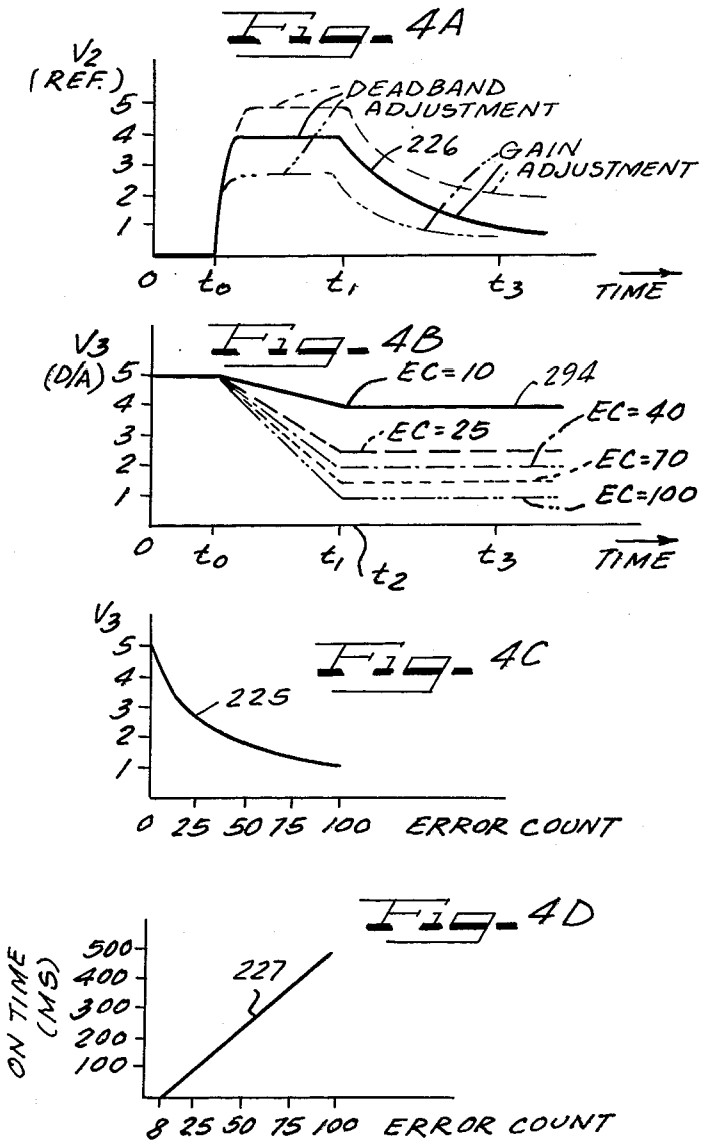
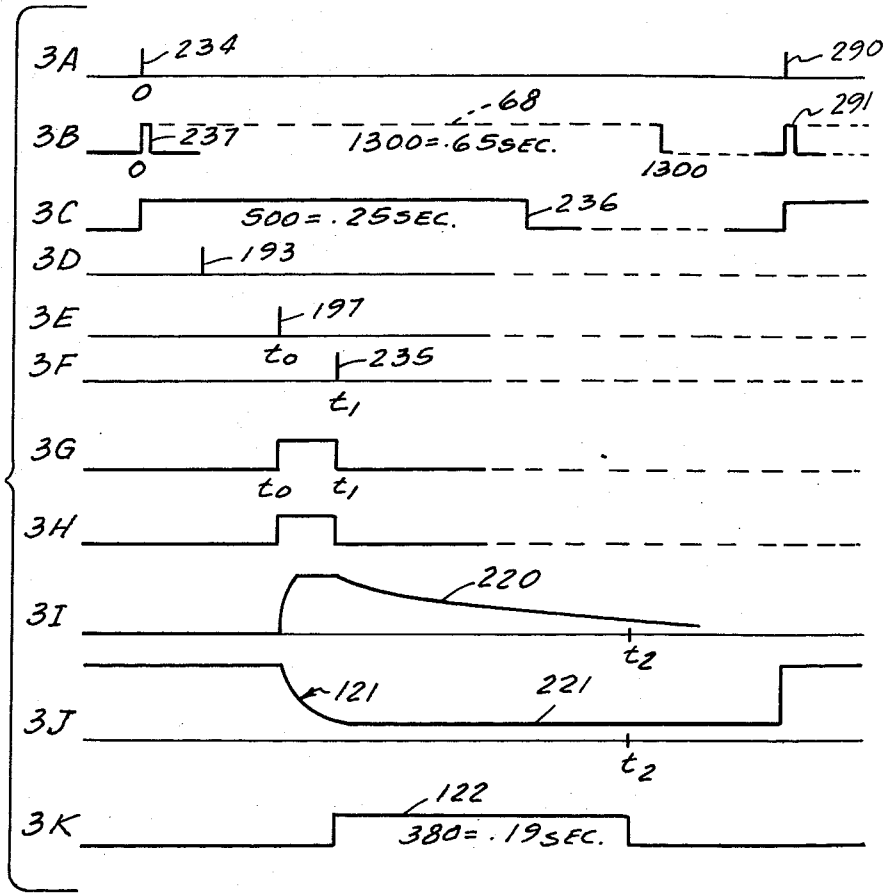
FIG. 3

ADVANCE
RETURN
AC (COMM)
220K
.0047
(.0047)
220K
BIDIRECTIONAL OUTPUT SERVO
274
270
272
275
AC(COMM)
BRAKE
Q502-1 SC146D
Q502-1
470Ω
470Ω
Q501-1 SC146D
470Ω
REED 3-1
REED 1-1
REED 2-1
AC(HOT)
271

274
281
270
282
283
284
275
10
14
+20V
+5V
22K
Q300-1 2N4354
1MEG
33
P300-1 5K
1N483
22K
22K
741A
4.7K
Q304-1 2N3566
3.9K
74A-1
(TO FIG. 8)
02D-1
02D-2
(3D)
181
.05
.001
22K
4.7uf
Q302-1 2N3568
22K
1N483
1MEG
4.7uf
1N2071
C304 1000/16
-5V
P301-1 5K
34
Q301-1 2N4354
22K
1MEG
1N483
22K
22K
741B
4.7K
Q305-1 2N3566
74A-2
(TO FIG. 8)
02D-4
(3F)
182
02D3
.05
.001
2.2K
4.7uf
Q303-1 2N3568
22K
1MEG
1N483
4.7uf
50
132
(FROM FIG. 5)

REGISTER CONTROL SYSTEM AND METHOD

SUMMARY OF THE INVENTION

This invention relates to a register control system and method and particularly to such a system for supplying output energization for a time duration in each error correction cycle substantially linearly proportional to error count. The system is applicable to both longitudinal and lateral registration control systems and preferably provides an adaptive error cycle control enabling frequent error correction cycles at relatively low web speeds without loss of proper error correction at higher web speeds.

An object of the invention is to provide a registration control system with a particularly simple, economical and reliable output circuit for supplying output energization to an error correction device for a time duration which is substantially linearly proportional to error count.

A further object is to provide a registration control system having provision for adapting the number of error cycles to web speed so as to enable a particularly effective control operation at relatively low web speeds and for lateral register control systems.

Further objects, features and advantages of the invention will be readily apparent from the following detailed description taken in connection with the accompanying drawings, although variations and modifications may be effected without departing from the spirit and scope of the novel concepts of the invention.

BRIEF DESCRIPTION OF THE DRAWINGS

FIG. 3 comprising FIGS. 3A through 3K shows a series of wave form diagrams useful for explaining the sequence of operation of the circuitry of FIG. 1;

FIG. 4A shows the variation as a function of time of the potential supplied by a resistance-capacitance charge flow circuit utilized in controlling the time duration of the supply of error correction output in each error correction cycle;

FIG. 4B shows the variation as a function of time of the analog error signal for certain indicated error count values;

FIG. 4C shows the variation in the analog error signal as a function of the error count value to be represented;

FIG. 4D is a diagrammatic illustration indicating the substantially linear relationship between the time duration of the error correction output and the error count for a system in accordance with the present invention;

DETAILED DESCRIPTION OF THE PREFERRED EMBODIMENT

Figures 1, 2:
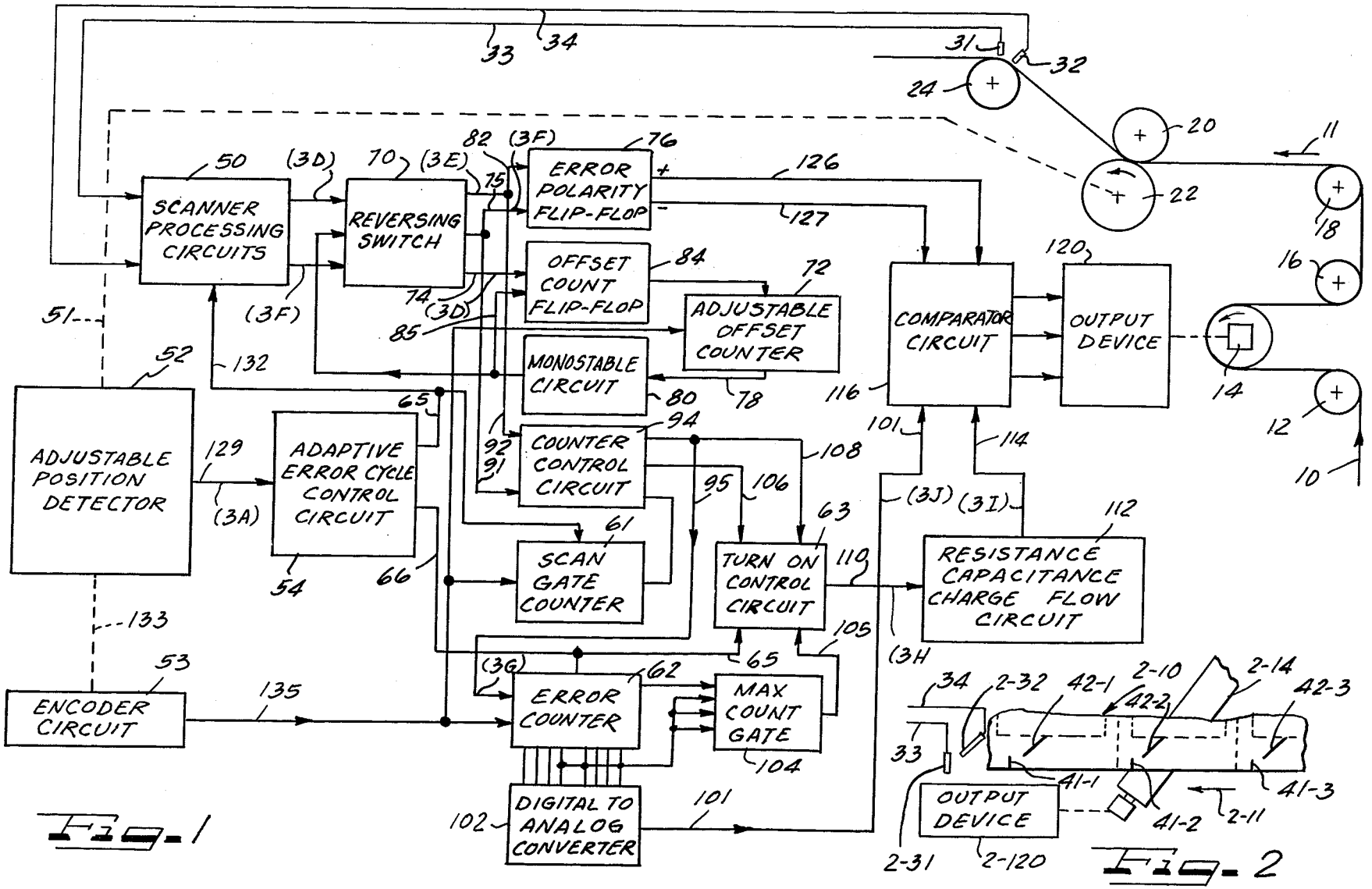
FIG. 1 is a block diagram illustrating a longitudinal register control system in accordance with the present invention.
FIG. 2 is a fragmentary diagrammatic illustration of a lateral register control system and which may utilize the same electrical components as represented in FIG. 1.

Referring to the block diagram of FIG. 1 which is given by way of example and not by way of limitation, a web is indicated at 10 as moving in the direction of arrow 11 progressively over rollers 12, 14, 16, 18, 20 and 22, and 24 as it moves through a given work station. As will be apparent from prior patents such as U.S. Pat. No. 3,468,201, issued Sept. 23, 1969, U.S. Pat. No. 3,594,552, issued July 20, 1971 and U.S. Pat. No. 3,601,587, issued Aug. 24, 1971, the web may be subjected to a printing operation at successive repeat lengths thereof, for example, by means of a roller such as diagrammatically indicated at 22. Many other types of converting operations may, of course, be applied to a web of articles or the like, and the diagrammatic illustration of FIGS. 1 and 2 is given simply by way of concrete example. As indicated in U.S. Pat. No. 3,624,359, issued Nov. 30, 1971, for example, it is known in the art that certain markings on the web 10 may be utilized as reference markings in the successive repeat lengths, and that further markings may be applied at a processing station such as represented by roller 22, whereupon the spacial relationship of such marks on the web at a scanner station such as indicated at 24 will serve to represent the register condition of the web relative to the work station. Thus, FIG. 1 diagrammatically indicates a pair of scanners 31 and 32 for respectively sensing (e.g. photoelectrically) the reference markings and the newly applied markings at the respective repeat lengths of the web.

An example of suitable scanner energizing and preamplifier circuitry as represented by each of the components 31 and 32 in FIG. 1 is found in U.S. Pat. No. 3,812,351, issued May 21, 1974. The outputs from the pre-amplifiers of components 31 and 32 are indicated as being coupled to the electric circuitry of FIG. 1 by means of cables represented by lines 33 and 34 in FIG. 1.

FIG. 2 illustrates a similar arrangement for purposes of lateral register control and shows a web 2–10 moving in the direction of arrow 2–11 over a lateral position control device designated 2–14. In FIG. 2, the web is shown in diagrammatic plan, to illustrate reference markings such as indicated at 41-1, 41-2 and 41-3 in a first longitudinal section of the web and to illustrate further markings which would be applied, for example, by means of a work station as indicated at 22 in FIG. 1, the lateral positions of the successive marks 42-1, 42-2 and 42-3 being laterally located on the web in accordance with the instantaneous lateral position of the web as it travels between the rollers 20 and 22. Accordingly, the phase of the electrical pulses produced by scanners 2–31 and 2–32 for the successive repeat lengths of the web will reflect the instantaneous lateral register condition at the work station of interest. The error correction device 2–14 would, of course, be properly associated with the work station so as to be capable of adjusting the lateral position of the web at the work station in response to error correction signals from the system of FIG. 1.

Since the electric circuitry represented in FIG. 1 operates in essentially the same manner, whether the scanner signals are supplied from scanners 31 and 32 as indicated in FIG. 1, or from scanners 2–31 and 2–32 in FIG. 2, a single description of the electric circuitry of FIG. 1 will be applicable to both types of register control problems.

Description of the Electric Circuitry of FIG. 1

The scanner signals arriving from scanner components 31 and 32 at the upper right in FIG. 1, or from scanner components 2–31 and 2–32 in FIG. 2, are further processed by scanner processing circuits of component 50 whose output pulses are indicated in FIGS. 3D and 3F, by way of example. The mechanical movement of the web 10 or 2–10 is coupled as indicated by dash line 51 with an adjustable position detector component 52 and with an encoder circuit component 53. Simply by way of example, components 52 and 53 may conform with the components shown in U.S. Pat. No. 3,812,351, issued May 21, 1974. The output of component 52 may be adjusted to occur at any point relative to a repeat length of the web, and occurs cyclically as a function of the movement of the web, a pluse occurring each time the web moves through a distance corresponding to the repeat length thereon.

Reference numeral 54 designates an adaptive error cycle control circuit for responding to the position detector signals such as indicated in FIG. 3A, and to produce suitable reset pulses such as indicated in FIG. 3B for resetting the various counters and other components of circuits 50, 61, 62 and 63. The output from component 54 as represented by line 65 merely supplies the complement of the signal appearing at output 66 and as indicated in FIG. 3B. As indicated by the dash line 68 in FIG. 3B, the adaptive error cycle control circuit may carry out a timing function having a predetermined time duration, and be such as to be insenstive to further position detector pulses until the termination of the timing cycle.

The output of the processing circuits component 50 is indicated in FIGS. 3D and 3F, for example, and these outputs are supplied via a reversing switch component 70 so that the first occurring scanner pulse may be supplied to an adjustable offset counter component 72 via a line indicated at 74, while the second occurring scanner signal such as indicated in FIG. 3F may be supplied via a line 75 directly to an error polarity flip-flop 76. A delayed scanner pulse is supplied from counter component 72 via line 78 and a monostable circuit 80 to a further pole of the reversing switch 70 whereupon this delayed scanner pulse as represented in FIG. 3E is supplied via conductor 82 to the error polarity flip-flop component 76. An offset count flip-flop 84 is set by the scanner pulse of FIG. 3D so as to cause the offset counter 72 to begin counting encoder pulses from encoder circuit 53, and the output of the offset counter 72 via line 78 and circuit 80 serves to reset the flip-flop 84 via line 85 so as to interrupt the offset counter operation.

The scanner signals on lines 75 and 82 at the output of reversing switch 70 are supplied via lines 91 and 92 to a counter control circuit 94 whose output line 95 controls the counting of encoder pulses by the error counter 62. The error count registered by error counter 62 is converted to an analog output at line 101 by means of a digital to analog converter component 102. A maximium count gate component 104 is responsive to a maximum count of the error counter 62 to signal control circuit 63 via line 105. Other inputs to the control circuit 63 are indicated at 106 and 108, so that the turn-on control circuit 63 is able to supervise the enabling of successive error correction cycles under various operating conditions. The output line 110 from control circuit 63 is supplied to a resistance-capacitance charge flow circuit 112 which provides a progressively changing analog output at output conductor 114 which is compared with the output of converter 102 at line 101 by means of a comparator circuit 116. The comparator circuit 116 serves to sense when there is a predetermined matching relationship between the analog inputs at lines 101 and 114 and to provide suitable actuating signals to an output device component 120 for maintaining the output device in an "on" condition for a time duration which is linearly proportional to the error count registered by error counter component 62.

Referring to FIG. 3, it will be observed that the delayed scanner pulse of FIG. 3E is effective to produce an error correction signal at output 110 of control circuit 63 as indicated in FIG. 3H. The charge flow circuit 112 is responsive to the signal shown in FIG. 3H to initiate a resistance-capacitance-controlled charge flow cycle as represented by wave form 220 in FIG. 31. The potential variation at input 101 to the comparator circuit 116 is diagrammatically indicated in FIG 3J by means of the wave form 121, the duration of the error correction cycle being indicated by the wave form 122 in FIG. 3K. The direction of operation of output device 120 is indicated as being controlled by polarity indicating lines 126 and 127 from the error polarity flip-flop 76. The polarity is such that the output device 120 will move the error correction device 14, FIG. 1, or 2–14, FIG. 2, in a direction to tend to reduce the error.

The further operation of the circuitry indicated in FIG. 1 will be further evident from a detailed description of the exemplary implementing electric circuit of of FIGS. 5–10A.

Description of the Circuitry of FIGS. 5–10A

Certain of the circuit detail of the illustrated circuit is similar in principle to that described in U.S. Pat. No. 3,812,351 issued May 21, 1974, so that a less detailed description is suitable herein. In numerous cases, as in the mentioned patent, reference characters are applied which correspond to the last two digits of commercial designations for transistor transistor logic integrated circuits. Thus, for example, in FIG. 5, the gates are given designations 02E-1, 02E-2 and 02E-3, and suitable implementing circuitry would comprise two-input positive NOR gates commercially available as circuit type SN 7402. Similarly, the exclusive NOR gates such as 42-1 and 42-2 in FIG. 6 could be implemented as circuit type SN 8242. (Other types of circuit elements may all be implemented as circuit types in the 7400 series.) The reference characters utilized in FIG. 1 have been repeated in FIGS. 5 through 10 where applicable so as to further facilitate a review of the detailed circuit. Also, reference characters such as (3A) shown at the left in FIG. 5 indicate that the waveform of the corresponding figure number, i.e. FIG. 3A, would be supplied at the indicated circuit location.

In order to facilitate implementation of the specific illustrated circuit, should this be desired, specific circuit values have been indicated for the components of the detailed circuit. In this respect, the notation K as applied to a resistor refers to a value of resistance in kilohms. Capacitance values which are indicated by a decimal number are in microfarads in each case. Other values of capacitance are indicated using the notation "$\mu$", standing for microfarads or "pf" standing for picofarads ($10^{-12}$ farads). Resistance values of less than one kilohm (1K) are indicated with the conventional symbol for ohms ($\Omega$).

FIG. 5

Figure 5:
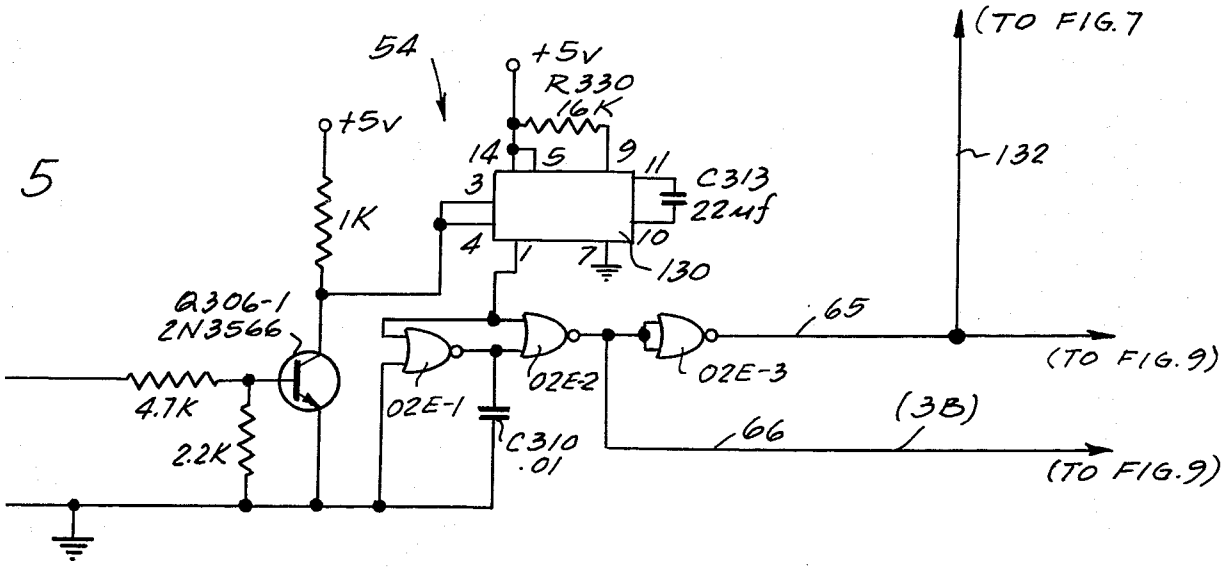
FIG. 5 shows an exemplary detailed electric circuit for implementing the adaptive error cycle control circuit component of FIG. 1.

Referring to FIG. 5, it will be observed that the waveform of FIG. 3A is supplied via line 129 and a 4.7 kilohm resistor to a transistor Q306-1, whose output triggers a monostable circuit 130. The output of monostable 130 in turn drives a series of gates so as to produce output pulses at conductors 63, 132 and 66.

The monostable multivibrator 130 may comprise a type Ser. No. 74121, for example. The commercial data for this type of circuit indicates that for an applied voltage between five and 5.25 volts, time as indicated at 68 in FIG. 3B, is defined by the relationship $t_p$ (out)= $C_T R_T \log_e 2$ over the full temperature range for more than six decades of timing capacitance (ten picofarads to ten microfarads) and more than one decade of timing resistance (2,000 ohms to 40,000 ohms). Thus, the circuit parameters for R330 (16 kilohms) and C313 (22 microfarads) are assumed to give a time constant of roughly 250 milliseconds.

Since with this type of circuit, once the monostable has been triggered, the outputs are independent of further transitions on the input and are a function only of the timing components, monostable 130 will automatically adaptably regulate the number of cycles which can be initiated by the input pulses at line 129, and the parameters controlling the timing function are selected to reduce the number of error cycles of the error sensing circuitry at relatively high web speeds, while accommodating error correction operation for each repeat length of the web at somewhat lower speeds.

For an embodiment with a similar output circuit but utilized for lateral register control of a moving web, the type Ser. No. 74121 monostable utilized a resistor such as R330 with a value of 30,000 ohms, and a capacitor corresponding to C313 again of 22 microfarads.

The monostable 130 of FIG. 5 is part of the adaptive error cycle control circuit 54 of FIG. 1, and will be discussed hereinafter in explaining the timing relationships of FIG. 3 and FIGS. 4A and 4B.

FIG. 6

Figure 6:
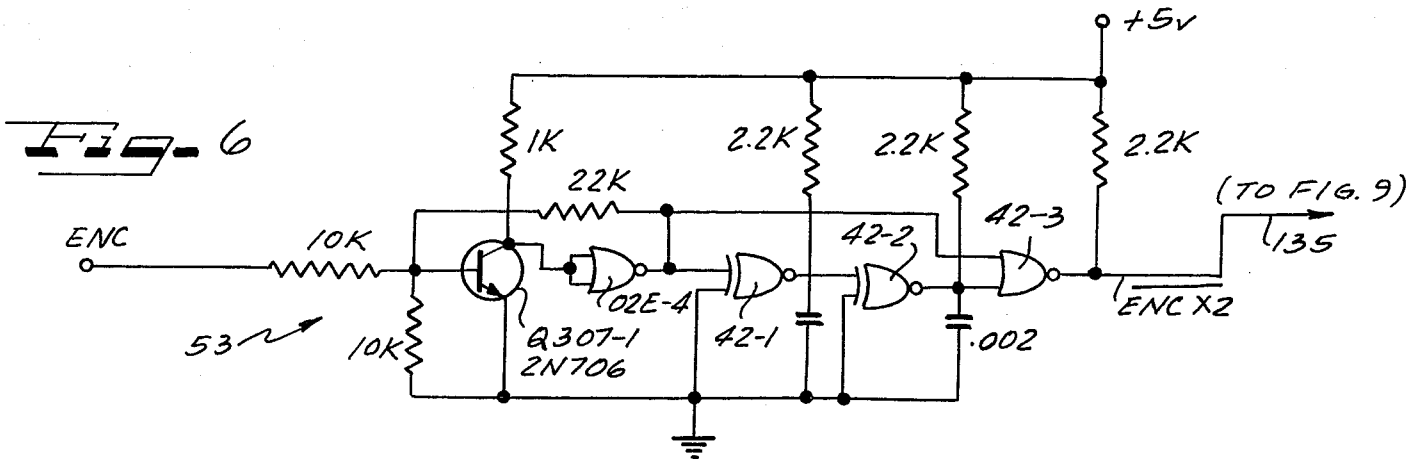
FIG. 6 illustrates an exemplary detailed electric circuit forming part of the encoder circuit component of FIG. 1.

The circuit of FIG. 6 involving transistor Q307-1 may serve to double the encoder pulse rate so as to supply at output conductor 135 pulses at a rate of 10,000 per revolution of the shaft 133, FIG. 1, driving the encoder of circuit 53, for example.

FIG. 7

Figures 7, 10, 10A:
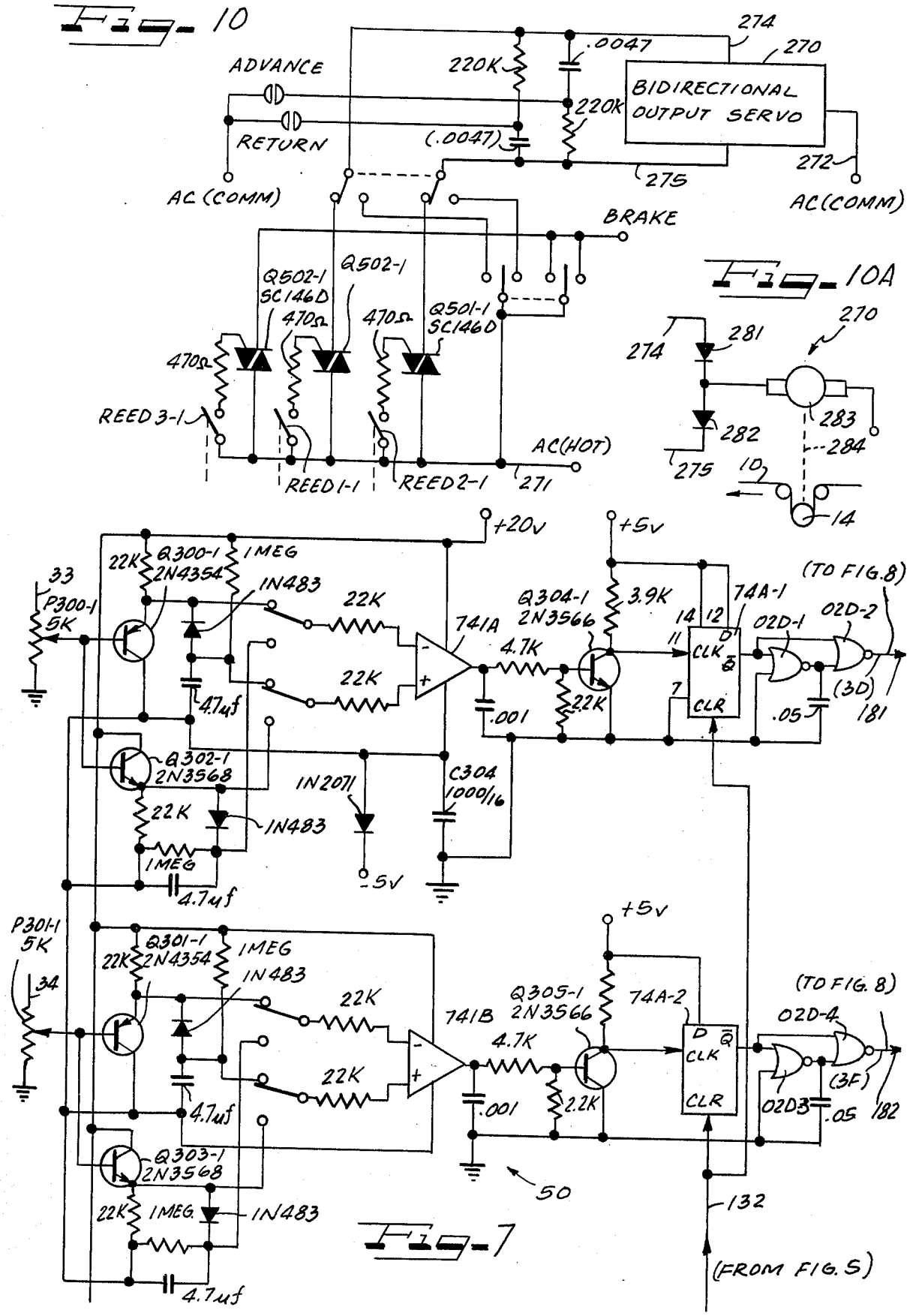
FIG. 7 illustrates exemplary circuit details for the scanner processing circuits component of FIG. 1.
FIG. 10 illustrates exemplary output drive circuitry including relay contacts which are controlled by the output circuitry shown in the upper right in FIG. 8.
FIG. 10A illustrates an exemplary bidirectional output servo embodiment for the servo component of FIG. 10.
Figure 8:
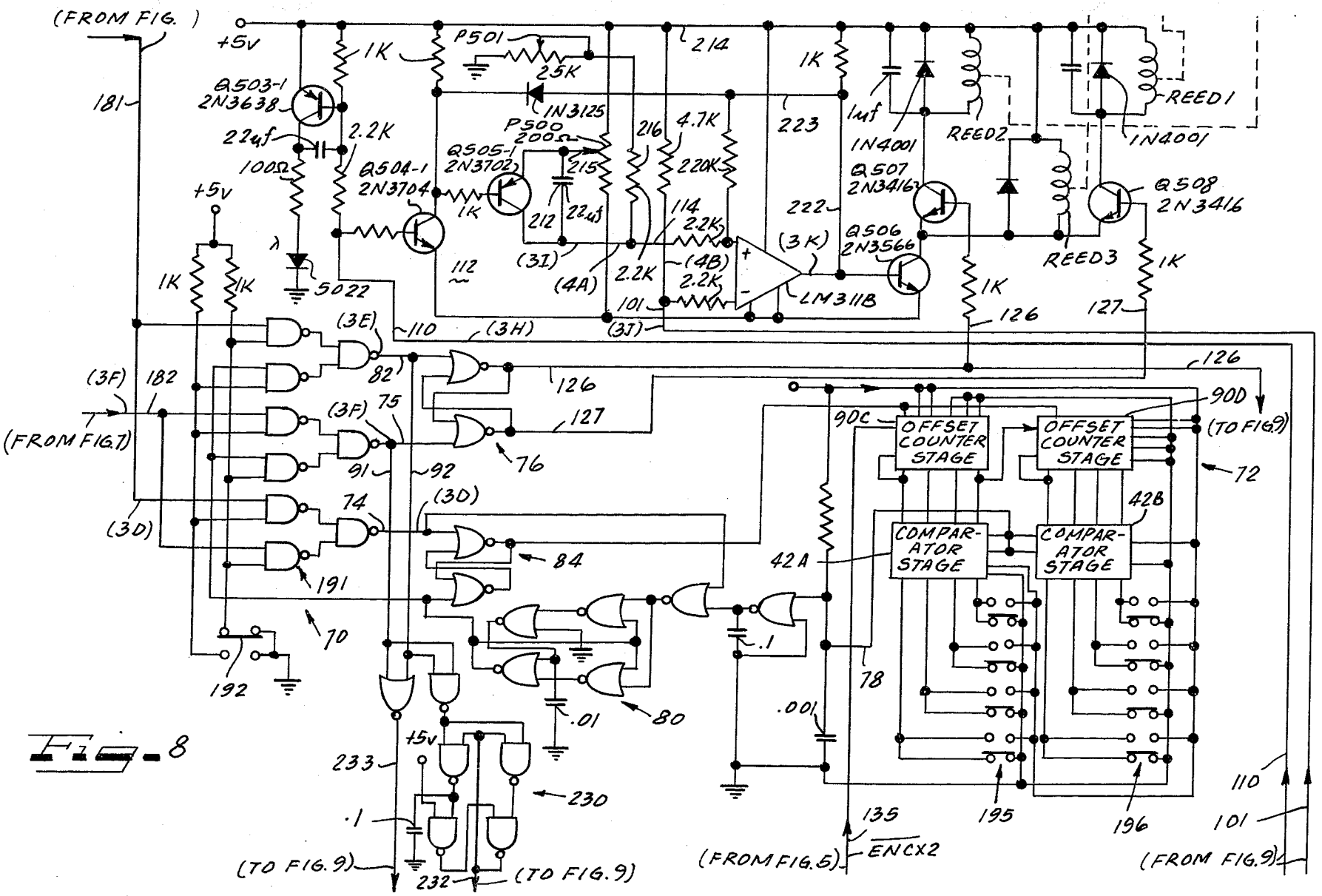
FIG. 8 shows exemplary circuitry for the error sensing control components of FIG. 1.

FIG. 7 illustrates channel scanner processing circuitry which forms part of component 50, FIG. 1, the pulse outputs of scanners 31 and 32 being processed in FIG. 7 and then being supplied via conductors 181 and 182 to the circuitry of FIG. 8. It will be noted that flip-flops 74A-1 and 74A-2 at the right in FIG. 7 must be reset from conductor 132 at the beginning of each inspection zone, or else the error sensing circuitry will be unable to carry out an error sensing cycle. Thus, at relatively high web speed, where monostable circuit 130, FIG. 5, fails to respond to alternate position detector pulses, for example, scanner pulses will also be blocked during alternate potential inspection zones.

FIG. 8

In FIG. 8, the scanner signals arriving via conductors 181 and 182 may have a time relationship as indicated in FIGS. 3D and 3F. The scanner pulses are selectively routed by means of gating circuit 192 which forms the three pole double throw switch of reversing switch component 70, FIG. 1, and which is controlled by means of a shiftable contact 192. The condition of the switch 70 may be selected so that the leading scanner pulse, such as pulse 193 as seen in FIG. 3D, will be transmitted to output 74 and thence to the adjustable offset counter 72 comprising counter stages 90C and 90D. The offset counter has thumb wheel switches as indicated at 195 and 196 for selecting a desired count value between zero and 99 with respect to the double rate encoder pulses supplied via conductor 135 from FIG. 5.

When the offset counter has completed the desired counting cycle, an output is supplied from comparator stages 42A and 42B via conductor 78, and this pulse serves to reset bistable circuit 84 and supply a delayed scanner pulse as indicated at 197 in FIG. 3E to output 82 of the switch 70. Accordingly, bistable 76 will assume a final condition in accordance with any significant error in phase between the two scanner pulses and supply a corresponding polarity signal to conductor 126 or conductor 127.

If polarity indicating conductor 126 is high, transistor Q507 will be enabled to allow energization of the relay coil designated "REED 1."

During the counting of encoder pulses to determine the error between the signals arriving at the respective inputs to flip-flop 76, the potential at conductor 110 at the extreme right in FIG. 8 will be high, turning on transistor Q504-1 at the upper left in FIG. 8. This, in turn, will turn on transistor Q505-1, and allow the discharge of capacitor 212. At the end of the inspection zone during proper operation, the potential of conductor 110 will return to ground level, turning off transistors Q504-1 and Q505-1 and enabling the charging of capacitor 212. The charging circuit for capacitor 212 extends from supply line 214 to movable tap 215 of potentiometer P500, and to the upper plate of capacitor 212, and from the lower plate of capacitor 212 through resistor 216 and potentiometer P501 to ground. As the capacitor 212 progressively charges, the potential of the plus input to amplifier RM311B progressively decreases as represented at 220 in FIG. 31. The extreme right hand conductor 101 in FIG. 8 leads from the error analog output of the error sensing circuitry and is applied to the minus input of amplifier LM311B. Thus, when capacitor 212 has charged sufficiently so that the potential at the upper input of LM311B matches the error signal indicated at 221 in FIG. 3J at the lower input, an output pulse occurs at the output line (providing transistor Q504-1 is nonconducting so that conductors 222 and 223 can approach supply potential). As capacitor 212 continues to charge, transistor Q506 is held on, energizing the selected one of the coils "REED 1" or "REED 2," and this results in turn on of the error correction servo for a time interval substantially linearly proportional to the error count determined by the error sensing circuitry.

Nonlinearity of the digital to analog converter circuit associated with the error counter as diagrammatically represented by curve 225, FIG. 4C, is compensated by the complementary nonlinearity of the capacitor charging circuit for capacitor 212, as diagrammatically represented at 226, FIG. 4A, so that the resultant on time of the selected REED relay will be linearly proportional to error count within approximately ten percent, for example, as diagrammatically indicated at 227, FIG. 4D. Potentiometer P500 is adjustable to define the extent of a "dead zone," or "deadband" as indicated in FIG. 4A, within which small errors will not cause the actuation of the output circuitry. Potentiometer P501 serves as a gain adjustment for the error count-to"on time" circuit and the effect of this adjustment is also diagrammatically indicated in FIG. 4A.

Figure 9:
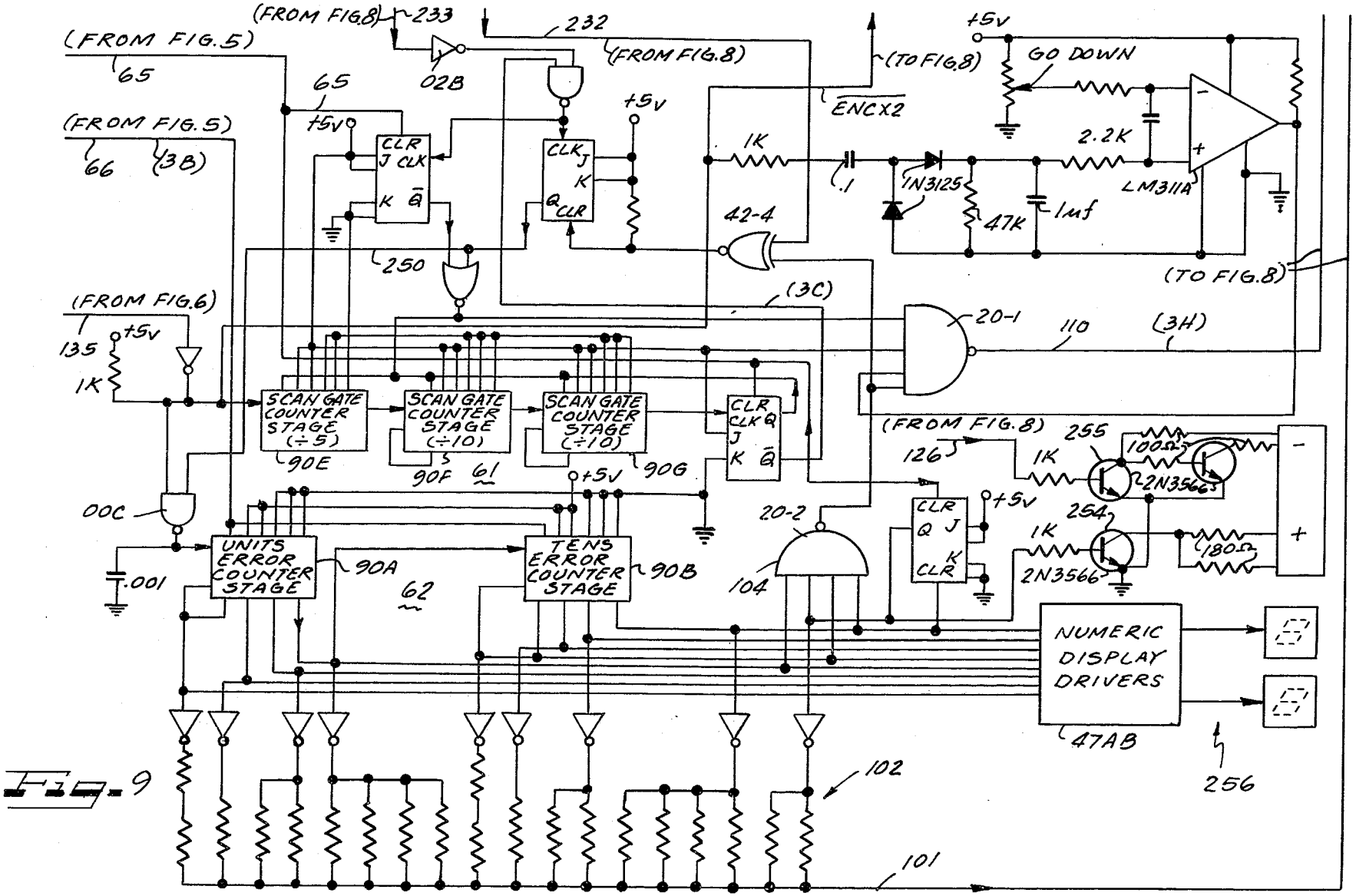
FIG. 9 illustrates further circuitry of the error sensing control components of FIG. 1.

Referring to the circuitry at the lower left in FIG. 8, monostable circuit 230 responds to substantial simultaneity at the conductors 91 and 92 of switch 70 and supplies a corresponding control signal to output conductor 232 leading to the circuitry of FIG. 9. Conductor 233 transmits the information with respect to the scanner phase to the circuitry of FIG. 9.

FIG. 9

As indicated at the upper left in FIG. 9, a reset signal is received from conductor 65 of FIG. 5 in response to the position detector signal indicated at 234, FIG. 3A. The result is that the inspection zone of the sensing circuitry of FIG. 9 is synchronized with web repeat length intervals. Preferably the scanner signals as indicated at 193, FIG. 3E, and 235, FIG. 3F, occur relatively early in the inspection zone (which is indicated at 236 in FIG. 3C). In particular, the reset signal which is the complement of that indicated at 237, FIG. 3B, at conductor 65, serves to reset the scan gate counter 61 comprising stages 90E, 90F and 90G at the center left of FIG. 9. Similarly, the reset pulse 237, FIG. 3B, which is supplied to conductor 66 at the upper left in FIG. 9 serves to reset the stages 90A and 90B of the error counter 62 at the beginning of the inspection zone, or scan gate interval.

When the leading pulse such as pulse 197 shown in FIG. 3E arrives via conductor 233 at the upper left of FIG. 9, the counter error counter stages 90A and 90B are enabled via conductor 250, and the error counter 62 begins counting the double rate encoder pulses supplied at input 135. The digital to analog converter 102 serves to supply an analog error signal to conductor 101 leading to the output control of FIG. 8 previously discussed. The error count is also supplied to component 47AB at the lower right in FIG. 9 and to transistor 254 so as to produce the digital error display in accordance with the registered error count. Transistor 255 of the display 256 is controlled from conductor 126 leading from the polarity sensing bistable 76 of FIG. 8. Thus, the correct polarity (plus or minus) is displayed in accordance with the time of arrival of the pulses at conductors 75 and 82 in FIG. 8.

If the error sensing circuitry is operating properly and the second scanner signal arrives within the inspection zone, the output of gate 20-1 will supply a ground potential to conductor 110 at the end of the inspection zone, enabling the output circuit of FIG. 8 as previously described.

FIGS. 10 and 10A

FIGS. 10 and 10A on sheet 4 of the drawings illustrate the output drive circuit which is indicated as being controlled by the relays REED 1, REED 2 and REED 3 of FIG. 8. Component 270 in FIG. 10 represents any suitable bidirectional output servo which may respond to alternating current energization applied between supply lines 271 and 272. With energization of reed relay coil REED 1, contact REED-1 is closed so that alternating current potential is supplied to conductor 274 in FIG. 10, while with the energization of reed relay coil REED 2, contact REED 2-1 is closed and alternating current potential may be supplied to conductor 275.

FIG. 10A illustrates an exemplary embodiment of bidirectional output servo 270 comprising a pair of rectifiers 281 and 282 controlling the polarity of energization of the armature winding of a direct current motor 283 having a permanent magnet field. The output of the motor as indicated by dash line 284 may be coupled to a web compensating device such as indicated at 14 in FIG. 1 so as to actuate the device in a direction tending to return the web to the desired longitudinal registration condition at the work station 22 indicated in FIG. 1.

SUMMARY OF OPERATION

Referring to FIG. 3, a position detector pulse 234 keyed to web movement causes production of a reset pulse 237 at conductor 66 shown at the lower right in FIG. 5. The timing cycle of monostable 130, FIG. 5, is indicated by dash line 68, FIG. 3B, and during this cycle, the monostable 130 will not respond to further detector pulses such as that indicated at 290. The time spacing between pulses 234 and 290, FIG. 3A, is a function of web speed, so that as web speed increases a succeeding pulse such as 290 would fall within the timing cycle indicated at 68, and the result would be that the succeeding reset pulse such as indicated at 291, FIG. 3B, would not occur. In this way monostable 130 adaptively controls whether there will be an error correction cycle for each position detector pulse such as 234 and 290, or only for every second or every third position detector pulse depending on speed. By selecting the parameters of the timing circuit for monostable 130, the time duration of timing cycle 68 may be such as to exceed the maximum possible motor energization interval (for maximum error count), the energization interval being represented at 122 in FIG. 3K.

As explained with reference to FIGS. 4A and 4C, the nonlinearity of the voltage produced by the digital to analog converter 102 shown at the lower center of FIG. 1 is compensated by a corresponding nonlinearity of the resistance-capacitance charge flow circuit shown at the lower right in FIG. 1, so that the resultant duration of the energizing pulse such as indicated at 122 in FIG. 3K will be linearly proportional to the digital error count as determined by error counter 62 shown at the lower center of FIG. 1. By way of example, the gain adjustment potentiometer P501 shown at the upper left of FIG. 8, and forming part of the charging circuit for capacitor 212, may be adjusted so that the motor on-time duration will be a linear function of error count within ten percent as diagrammatically indicated in FIG. 4D.

The comparator circuit for determining when curve 226, FIG. 4A produced by the resistance-capacitance timing cycle reaches a matching value to the error voltage level such as 294, FIG. 4B, for example (representing the voltage level for an error count of ten encoder pulses), is indicated at 116 at the right in FIG. 1 and may be implemented as a differential amplifier as indicated at LM 311 B at the upper center in FIG. 8. The amplifier LM 311 B may supply the output signal 112, FIG. 3K, for a time duration linearly proportional to the phase error measured in encoder pulses between pulses 197, FIG. 3E, and 235, FIG. 3F. (For zero error, pulses 197 and 235 will be time coincident.) The equalities associated with waveforms 68, 236 and 122 in FIG. 3, suggest that for a web speed of 2000 encoder pulses per second, a timing cycle 68 of 0.65 seconds would exceed the time duration of a 500 encoder pulse inspection zone as indicated at 236. At this speed a motor-on signal could occur at a time $t_1$ of about 0.15 second, taking pulse 234 as occuring at time $t$=0. Then a maximum motor on-time referring to FIG. 3K and 4D would be about 0.5 second. Beyond such a maximum motor on-time (neglecting motor deenergization time), the motor could run continuously, interfering with proper control operation. Thus the duration of timing cycle 68, FIG. 3B, should be appreciably greater than the motor on-time corresponding to the maximum permitted error count.

It will be apparent that many modifications and variations may be effected without departing from the scope of the novel concepts of the present invention.

I claim as my invention:

1. In a register control system for operating an output device so as to tend to maintain a register condition between successive repeat lengths of a moving web and a cyclically operating work applying means operating thereon, an error sensing control comprising an encoder for generating encoder pulses as a function of successive increments of web movement, and comprising position detector means responsive to web movement to define a succession of inspection zone intervals synchronized with successive repeat lengths on the web during which error counting cycles are permitted, an error counter connected with said encoder and operable for counting encoder pulses in successive error counting cycles within the respective inspection zone intervals, a counter control circuit connected with said error counter for controlling the counting of encoder pulses thereby, and responsive to a timing error between the cyclically operating work applying means and the moving web to enable an error counting cycle of the error counter for the duration of the timing error, and to produce successive error counts in accordance with the magnitudes of such timing errors, a digital to analog converter connected to the error counter and operable for generating an analog error signal in accordance with the error count in said error counter, and an error responsive control connected with said error sensing control and being responsive to operation thereof to define successive error correction enabling intervals at the termination of respective error counting cycles, said error responsive control comprising a comparator having first and second inputs and having an output for controlling the output device and being operable to maintain an ouput enabling condition at said output so long as the signals at the respective inputs have a predetermined comparison relationship, said first input of said comparator being connected with said digital to analog converter to receive a signal amplitude generally in accordance with the magnitude of said analog error signal, and a resistance-capacitance charge flow circuit connected with said second input of said comparator to provide a progressively changing signal amplitude as a function of time at said second input during a resistance-capacitance controlled charge flow cycle, and said error responsive control being operable for initiating a resistance-capacitance-controlled charge flow cycle during the error correction enabling intervals and for supplying a driving signal to the output device for a time duration corresponding to the time required for the signal amplitude applied to said second input of said comparator to attain a comparison relationship different from said predetermined comparison relationship to the signal amplitude at said first input of said comparator during each such error correction enabling interval.

2. A system in accordance with claim 1 with said error responsive control comprising a timing circuit having an active timing cycle of greater time duration than the maximum time duration of the output enabling condition available from said comparator, and circuitry coupling said error sensing control with said error responsive control for actuating said timing circuit to begin its active timing cycle in each cycle of operation of said error sensing control and for preventing the error sensing control from beginning a new error counting cycle for the duration of said active timing cycle.

3. In a register control system for controlling a register condition at a work station operatively associated with a path of movement of a web, register sensing means for sensing a register condition of the web relative to the station and including position detector means responsive to movement of the web to determine successive cycles of operation corresponding to successive repeat lengths on the web, and said register sensing means being operable in each cycle of operation for generating register signals whose phase relationship is a measure of any deviation from a desired register condition, an error circuit responsive to an actuating signal to effect an error sensing cycle and connected with said register sensing means for receiving said register signals therefrom and for generating an error signal in each error sensing cycle in accordance with the magnitude of any deviation from the desired register condition, and an adaptive error cycle control circuit connected with said position detector means and operable to control the generation of said actuating signal, said error cycle control circuit having an input circuit coupled with said position detector means and normally operable for causing the generation of one of said actuating signals in each cycle of operation of said register sensing means, but being operable at relatively high repetition rates of the cycle of operation of said register sensing means to reduce the rate of generation of said actuating signals, thereby to provide for the generation of an error signal in each cycle of operation of said register sensing means at relatively low web speed without detriment to registration control at relatively higher web speeds.

* * * * *